US008511099B2

(12) United States Patent
Geary

(10) Patent No.: US 8,511,099 B2
(45) Date of Patent: Aug. 20, 2013

(54) COMBUSTOR SYSTEM

(75) Inventor: Alan P. Geary, Bristol (GB)

(73) Assignee: Rolls-Royce PLC, London (GB)

( * ) Notice: Subject to any disclaimer, the term of this patent is extended or adjusted under 35 U.S.C. 154(b) by 425 days.

(21) Appl. No.: 12/904,242

(22) Filed: Oct. 14, 2010

(65) Prior Publication Data

US 2011/0120141 A1 May 26, 2011

(30) Foreign Application Priority Data

Nov. 23, 2009 (GB) ..... 0920371.2

(51) Int. Cl.
*F02C 7/20* (2006.01)
*F23R 3/50* (2006.01)

(52) U.S. Cl.
USPC ..... 60/800; 60/804; 60/752

(58) Field of Classification Search
USPC ..... 60/800, 796, 798, 804, 752
See application file for complete search history.

(56) References Cited

U.S. PATENT DOCUMENTS

| | | | | |
|---|---|---|---|---|
| 2,625,794 | A * | 1/1953 | Williams et al. | 60/800 |
| 4,191,011 | A * | 3/1980 | Sweeney et al. | 60/796 |
| 4,195,475 | A * | 4/1980 | Verdouw | 60/754 |
| 4,785,623 | A | 11/1988 | Reynolds | |
| 5,211,675 | A * | 5/1993 | Bardey et al. | 60/752 |
| 2007/0107710 | A1 | 5/2007 | De Sousa et al. | |
| 2008/0155988 | A1 | 7/2008 | Commaret et al. | |

FOREIGN PATENT DOCUMENTS

| | | | |
|---|---|---|---|
| EP | 2 019 264 | A1 | 1/2009 |
| WO | WO 01/64368 | A1 | 9/2001 |

OTHER PUBLICATIONS

Great Britain Search Report dated Mar. 18, 2010 in Great Britain Patent Application No. GB0920371.2.

* cited by examiner

*Primary Examiner* — Ted Kim
(74) *Attorney, Agent, or Firm* — Oliff & Berridge, PLC

(57) ABSTRACT

A combustor system is provided for a gas turbine engine. The combustor system includes an annular combustion chamber, and outer and inner casings housing the combustion chamber. The outer casing is outwardly radially spaced from the combustion chamber and the inner casing being inwardly radially spaced from the combustion chamber. The combustor system further includes an attachment arrangement at the rearward end of the combustion chamber for attaching the combustion chamber to the engine. The attachment arrangement axially restrains the rearward end of the combustion chamber relative to the casings. The combustor system further includes a first stop surface formed at the forward end of the combustion chamber adjacent a selected one of the outer and inner casings, and a corresponding first baulking surface axially forward of the first stop surface formed by the selected casing. The first stop surface and the first baulking surface are spaced from each other to allow forward axial movement of the combustion chamber relative to the selected casing. However, the amount of relative forward axial movement is limited by engagement of the first stop surface with the first baulking surface.

8 Claims, 2 Drawing Sheets

COMBUSTOR SYSTEM

The present invention relates to a combustor system for a gas turbine engine.

FIG. 1 shows a longitudinal cross-section through one side of a typical annular combustion system for an aero gas turbine engine. The combustion system has an annular combustion chamber 1 axially aligned with the axis of the engine, the combustion chamber being contained within radially outer 2 and inner 3 casings.

Compressed air is ducted to the combustion chamber from the compressor section of the engine via a diffuser 4, which reduces the axial velocity of the compressed air and increases its pressure. The ducted air passes into the combustion chamber 1 through holes in a meter panel 5 at the forward end of the combustion chamber and also along cavities formed between the outer 2 and inner 3 casings and the corresponding barrel-shaped outer 6 and inner 7 combustion liners which extend rearwardly from the meter panel to define respective walls of the combustion chamber. Openings in the combustion liners allow the ducted air to enter the combustion chamber from these cavities.

Fuel is introduced into the forward end of the combustion chamber 1 by fuel injectors 8, such as airspray nozzles. At the rearward end of the combustion chamber, the hot combusted gases enter the turbine section of the engine, via an annular gap formed between radially outer 9 and inner 10 discharge nozzles which extend rearwardly from respectively the outer 6 and inner 7 combustion liners. The first element of the turbine section encountered by the hot gases is typically a row of nozzle guide vanes (NGVs) 11.

Although the meter panel 5 and combustion liners 6, 7 are protected from the high temperatures within the combustion chamber by the flow of ducted compressed air and various heat shield arrangements, the structural body of the combustion chamber nonetheless undergoes large thermal excursions and correspondingly large cycles of thermal expansion and contraction.

Accordingly, the combustion chamber 1 must be mounted to the engine in such a way as to accommodate significant differential thermal movements. In the combustion system of FIG. 1, the mounting arrangement comprises an attenuation arm or cone 12 which extends from the outer combustion liner 6 to the outer casing 2. This arm provides axial and radial restraint, but being relatively flexible allows a degree of movement of the combustion chamber, particularly in the radial direction of the engine. The mounting arrangement further comprises a bayonet-style fixing 13 between two rows of spaced teeth respectively formed at a projection at the rearward end of inner discharge nozzle 10 and a mating projection at the forward end of the NGV inner platform 14. This fixing provides axial restraint in the event of a surge.

Thus, as the combustion chamber 1 is essentially axially fixed relative to the casings 2, 3 at its rearward end, differential thermal contractions or expansions in the axial direction of the engine between the combustion chamber and the casings produce their largest relative axial movements at the forward end of the combustion chamber. The interface of the fuel injectors 8 to the combustion chamber is configured to accommodate these movements.

The attenuation arms 12 and bayonet-style fixing 13 also have to be strong enough to cope with surge events. These events involve the loss of compressor delivery pressure, resulting in a net axially forward piston-type load on the combustor chamber. The surge load is reacted by the attenuation arms and bayonet-style fixing restraining the outer 6 and inner 7 liners at their rearward ends, the combustor being generally insufficiently stiff to react this load at the end of only one of the liners without excessive deformation and the risk of damage. By reacting the load via both liners, the combustor chamber geometry and its relationship to adjacent components are maintained. That part of the surge load applied to the NGV inner platform 14 is transmitted forwards via the inner casing 3 and diffuser 4, to the outer engine casings.

Some civil aero gas turbine engines mount the combustion chamber to the outer casing at the forward end of the chamber so that the maximum relative axial movement between the chamber and the casings is removed to the rearward end of the chamber. The resulting lack of significant relative axial movement between the fuel injectors and combustion chamber front is considered advantageous to certain aspects of engine performance. The relative movement can be accommodated by sliding seals between the outer and inner combustion liners and their respective outer and inner discharge nozzles.

It would be desirable to provide alternative arrangements for supporting combustion chambers in order to reduce manufacturing costs while protecting the combustion chamber against surge events.

Accordingly, a first aspect of the present invention provides a combustor system for a gas turbine engine, the combustor system including:

an annular combustion chamber, outer and inner casings housing the combustion chamber, the outer casing being outwardly radially spaced from the combustion chamber and the inner casing being inwardly radially spaced from the combustion chamber, and an attachment arrangement at the rearward end of the combustion chamber for attaching the combustion chamber to the engine, the attachment arrangement axially restraining the rearward end of the combustion chamber relative to the casings; wherein the combustor system further includes a first stop surface formed at the forward end of the combustion chamber adjacent a selected one of the outer and inner casings, and a corresponding first baulking surface axially forward of the first stop surface formed by the selected casing, the first stop surface and the first baulking surface being spaced from each other to allow forward axial movement of the combustion chamber relative to the selected casing, the amount of relative forward axial movement being limited by engagement of the first stop surface with the first baulking surface.

The clearance between the first stop surface and the first baulking surface can be enough to accommodate relative axial movement between the chamber and the selected casing caused by thermal expansion of the combustion chamber during normal engine operation. However, advantageously, the first stop surface and the first baulking surface can be positioned so that they move into engagement and react the load on the combustion chamber to the selected liner during a surge event. That is, they can provide a surge bump stop. By relieving the attachment arrangement of the need to restrain the entirety of the surge load, the attachment of the combustion chamber to the engine can be simplified.

The combustor system may have any one or, to the extent that they are compatible, any combination of the following optional features.

Typically, the attachment arrangement also radially restrains the rearward end of the combustion chamber relative to the casings.

Preferably, there is no arrangement to axially restrain the forward end of the combustion chamber relative to the casings other than the first stop surface and the first baulking surface.

Preferably, the selected casing is the inner casing.

Typically, the attachment arrangement reacts axial loads on the combustion chamber to the other of the outer and inner casings. In this way, both the radially inner and radially outer sides of the combustion chamber can be axially restrained during a surge event, which can help to preserve the integrity of the combustion chamber. The attachment arrangement may extend from the combustion chamber directly or indirectly to the other of the outer and inner casings.

Indeed, due to the presence of the first stop surface and the first baulking surface, the attachment arrangement at the rearward end of the combustion chamber may not need to react axial loads on the combustion chamber to the selected casing. This can reduce component costs and simplify assembly procedures. For example, particularly if the selected casing is the inner casing, a bayonet-style fastening of the type shown in FIG. 1 (between the rearward end of an inner discharge nozzle and the forward end of an NGV inner platform) reacting axial loads on the combustion chamber to inner casing may be unnecessary.

As mentioned above, the attachment arrangement typically also radially restrains the rearward end of the combustion chamber relative to the casings. The combustor system can then further include a second stop surface formed at the forward end of the combustion chamber adjacent the selected casing, and a corresponding second baulking surface formed by the selected casing, the second stop surface and the second baulking surface being radially spaced from each other to allow radial movement of the forward end of the combustion chamber relative to the selected casing, the amount of relative radial movement being limited by engagement of the second stop surface with the second baulking surface.

The second stop surface and the second baulking surface can help to avoid excessive bending moments at the rearward end of the combustion chamber and in the attachment arrangement.

Preferably, there is no arrangement to radially restrain the forward end of the combustion chamber relative to the casings other than the second stop surface and the second baulking surface.

The combustion chamber typically has a barrel-shaped outer combustion liner, a barrel-shaped inner combustion liner coaxial with the outer combustion liner, and a ring-shaped meter panel which extends between forward ends of the outer and inner combustion liners. Conveniently, the first stop surface can then be formed by a projection extending from the meter panel towards the selected casing. When the combustion chamber also has a second stop surface, that surface may also be formed by the projection.

The projection and/or the selected casing can contain flow passages, such as through-holes of edge recesses, which allow compressed air delivered by the compressor of the engine to flow past the projection and into the cavity formed between the selected casing and the corresponding combustion liner.

A second aspect of the present invention provides a gas turbine engine having the combustor system of the first aspect, the combustor system optionally having any one, or to the extent that they are compatible, any combination of the optional features of the first aspect.

Embodiments of the invention will now be described by way of example with reference to the accompanying drawings in which.

Figure 2:
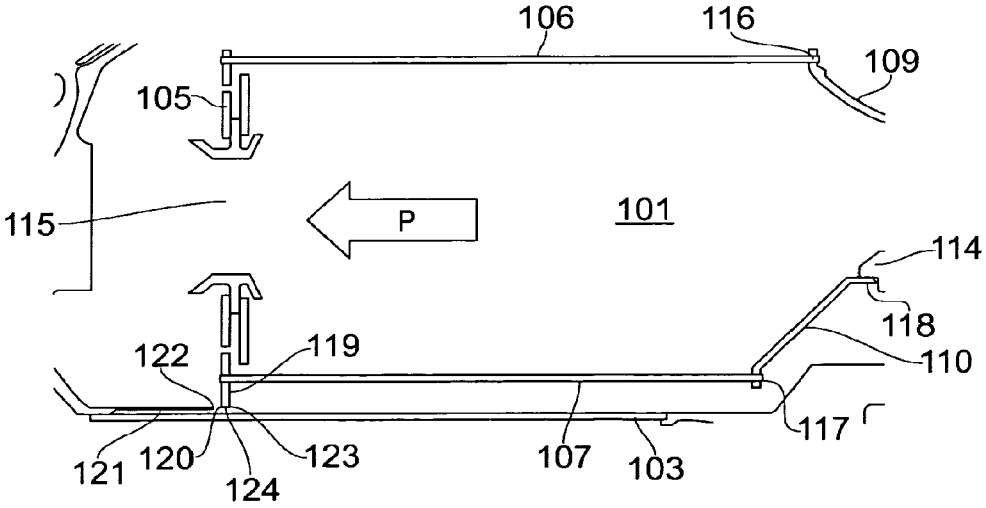
FIG. 2 shows a schematic longitudinal cross-section through one side of an annular combustion system according to the present invention.

FIG. 2 shows a schematic longitudinal cross-section through one side of an annular combustion system according to the present invention. An annular combustion chamber 101 has a barrel-shaped outer 106 and inner 107 combustion liners. A meter panel 105 extends between the forward edges of these two liners. The chamber is housed in the annular space formed between a radially outer casing (not shown) and a radially inner casing 103. Fuel injectors (not shown) extend through openings 115 in the meter panel to introduce fuel into the chamber.

The rearward end of the combustion chamber 101 is mounted to the engine via a connection 116 (e.g. a weld or mechanical fastening) between a rearward edge of the outer liner 106 and a forward edge of outer discharge nozzle 109. Loads transmitted from the outer liner to the outer discharge nozzle are transmitted further by paths (not shown) to the outer casing. For example, the outer discharge nozzle in turn can be fastened via e.g. slot rivets (as described in WO 01/64368 A1) to an outer platform of the NGVs of the turbine section. The mounting provides both an axial and radial restraint on the combustion chamber relative to the outer and inner 103 casings.

The rearward end of the combustion chamber 101 is joined by a connection 117 (e.g. a weld or mechanical fastening) at the rearward edge of the inner liner 107 to the forward edge of inner discharge nozzle 110. This in turn is joined by a simple spigot arrangement 118 at its rearward edge to an inner platform 114 of the NGVs. The spigot fit provides radial location but no axial restraint. However, the stiffness and integrity of the combustor structure are adequate for such an attachment arrangement under normal running conditions.

In the event of a surge, the inboard portion of the meter panel 105 and the inner liner 107 are likely to deflect forwards due to their relative flexibility and the lack of axial restraint at the rearward edge of the inner liner. To prevent excessive deflection and possible damage, a physical "bump-stop" arrangement is provided as follows. The meter panel extends inboard as a ring-shaped projection 119 sufficiently far that a forward-facing stop surface 120 of the projection is located axially rearwardly of an extension feature 121 of the inner casing 103. A rearward-facing surface of the extension feature forms a baulking surface 122 is spaced from the stop surface, allowing the forward end of the combustion chamber to move axially forward relative to the inner casing as the chamber thermally expands under normal operating conditions. However, during a surge event, when a strong forward pressure load (indicated by the arrow, P) is exerted on the combustion chamber, the stop surface makes contact with the baulking surface 122 to prevent excessive meter panel combustion chamber deflection.

The inboard surface of the projection 119 and the radially facing surface of the casing form respectively a second pair of stop 123 and baulking 124 surfaces which steady the forward end of the combustor in the radial direction. The clearance, under normal operating conditions, between the second pair of stop and baulking surfaces is less than that between first pair of stop 120 and baulking 122 surfaces because the amount of relative radial movement caused by thermal expansion of the combustion chamber is less in the radial direction than in the axial direction.

Figure 3:
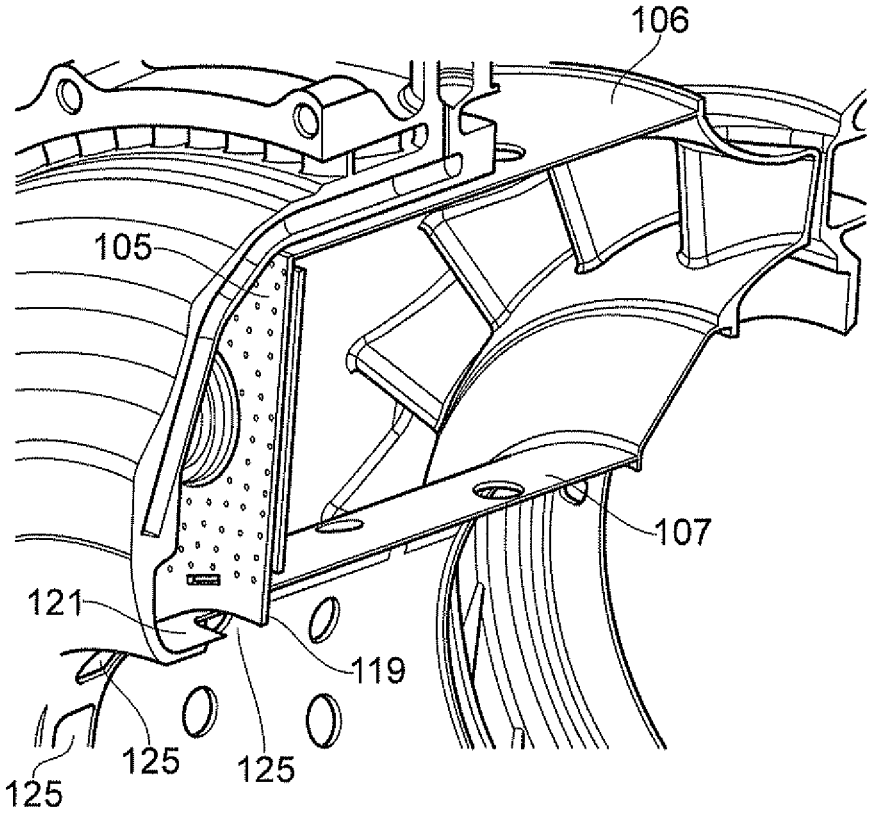
FIG. 3 is a perspective cut-away view of the annular combustion system of FIG. 2.

The projection 119 forms a restriction to airflow between the inner casing 103 and the inner liner 107. Optionally, therefore, through-holes or recesses in the projection 119 and/or in the extension feature 121 may be incorporated to meter larger flows between the inner casing 103 and the inner liner. FIG. 3 is a perspective cut-away view of the annular combustion system of FIG. 2, and shows recesses 125 in the extension feature 121. The inner casing rearward of extension feature 121 is not shown in FIG. 3.

Figure 1:
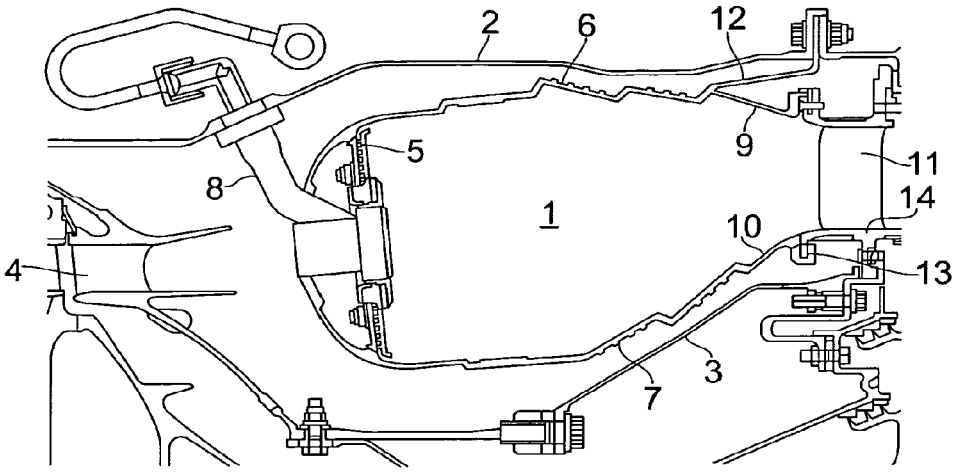
FIG. 1 Prior Art
FIG. 1 shows a longitudinal cross-section through one side of a typical annular combustion system for a military aero gas turbine engine.

Advantageously, the stop and baulking surfaces can reduce the complexity of the attachment arrangement at the rearward end of the combustion chamber needed to mount the chamber to the engine. For example, a relatively simple spigot arrangement 118 at the inner side of the chamber can replace the bayonet-style fixing 13 of the combustor system of FIG. 1 above.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting.

All references referred to above are hereby incorporated by reference.

The invention claimed is:

1. A combustor system for a gas turbine engine, the combustor system including:

an annular combustion chamber having a forward end receiving at least one fuel injector and a rearward end adjacent a turbine, outer and inner casings housing the combustion chamber, the outer casing being outwardly radially spaced from the combustion chamber and the inner casing being inwardly radially spaced from the combustion chamber, and an attachment arrangement at the rearward end of the combustion chamber for attaching the combustion chamber to the engine, the attachment arrangement axially restraining the rearward end of the combustion chamber from movement relative to the casings;

wherein the combustor system further includes a first stop surface formed at the forward end of the combustion chamber adjacent a selected one of the outer and inner casings, and a corresponding first baulking surface axially forward of the first stop surface formed by the selected casing, the first stop surface and the first baulking surface being spaced from each other to allow forward axial movement of the combustion chamber relative to the selected casing, the amount of relative forward axial movement being limited by engagement of the first stop surface with the first baulking surface.

2. A combustor system according to claim 1, wherein the attachment arrangement reacts axial loads on the combustion chamber to the other of the outer and inner casings.

3. A combustor system according to claim 1, wherein the selected casing is the inner casing.

4. A combustor system according to claim 1, wherein:

the attachment arrangement also radially restrains the rearward end of the combustion chamber relative to the casings, and the combustor system further includes a second stop surface formed at the forward end of the combustion chamber adjacent the selected casing, and a corresponding second baulking surface formed by the selected casing, the second stop surface and the second baulking surface being radially spaced from each other to allow radial movement of the forward end of the combustion chamber relative to the selected casing, the amount of relative radial movement being limited by engagement of the second stop surface with the second baulking surface.

5. A combustor system according to claim 4, wherein the combustion chamber has a barrel-shaped outer combustion liner, a barrel-shaped inner combustion liner coaxial with the outer combustion liner, and a ring-shaped meter panel which extends between forward ends of the outer and inner combustion liners, the first stop surface being formed by a projection extending from the meter panel towards the selected casing, and wherein the second stop surface is also formed by the projection.

6. A combustor system according to claim 1, wherein the combustion chamber has a barrel-shaped outer combustion liner, a barrel-shaped inner combustion liner coaxial with the outer combustion liner, and a ring-shaped meter panel which extends between forward ends of the outer and inner combustion liners, the first stop surface being formed by a projection extending from the meter panel towards the selected casing.

7. A combustor system according to claim 6, wherein the projection and/or the selected casing contain flow passages which allow compressed air delivered by the compressor of the engine to flow passed the projection and into the cavity formed between the selected casing and the corresponding combustion liner.

8. A gas turbine engine having the combustor system of claim 1.

* * * * *